US005641272A

United States Patent [19]

Harrold

[11] Patent Number: 5,641,272

[45] Date of Patent: Jun. 24, 1997

[54] ENHANCED LEVER MECHANISM FOR CONTROLLERLESS PNEUMATIC PUMP

[75] Inventor: Matthew Harrold, Oakland, Calif.

[73] Assignee: Clean Environment Engineers, Oakland, Calif.

[21] Appl. No.: 578,781

[22] Filed: Dec. 22, 1995

[51] Int. Cl.[6] ..... F04F 1/06

[52] U.S. Cl. ..... 417/133; 417/131

[58] Field of Search ..... 417/126, 131, 417/133

[56] References Cited

U.S. PATENT DOCUMENTS

| | | | |
|---|---|---|---|
| 1,127,726 | 2/1915 | Buckley | 417/133 |
| 1,372,931 | 3/1921 | Brown | 417/131 |
| 1,767,477 | 6/1930 | Rogers et al. | 417/131 |
| 2,241,765 | 5/1941 | Chambers | 417/131 |
| 3,972,650 | 8/1976 | Brennan | 417/133 X |
| 4,025,237 | 5/1977 | French | 417/131 |
| 4,395,200 | 7/1983 | Anthony et al. | 417/131 |
| 5,005,405 | 4/1991 | Breslin | 417/131 |
| 5,141,404 | 8/1992 | Newcomer | 417/133 X |
| 5,358,037 | 10/1994 | Edwards et al. | 166/105 |
| 5,358,038 | 10/1994 | Edwards et al. | 166/105 |

*Primary Examiner*—Richard E. Gluck
*Attorney, Agent, or Firm*—Townsend and Townsend and Crew LLP

[57] ABSTRACT

In float actuated pump having a rod and lever actuation from the float, an improved connect between the rod and lever is disclosed enabling valve opening substantially free of constraint by the rod and attached fittings. Such arrangement also enabling exhaust valve opening in a two-step momentum inducing method. Specifically, a valve actuating lever biased by a counter weight at one lever end, connects to the operating rod at the improved joint at the other lever end. The end of the rod is provided with an arcuate slot made of magnetic attractive material. The lever connects at a lever pin to the arcuate slot. The curvature of the slot prevents towards and away movement of the rod; the length of the slot gives free up and down rod movement at the lever pin within the elongate slot. At the top of the travel of the arcuate slot, a magnet is included in the pump head. This magnet has sufficient strength to support the rod and all attachments; the magnet has insufficient strength to support the float when added to the rod and all attachments. When rod actuation to open the air inlet valve occurs, the lever moves free of rod constraint by movement with the elongate slot and the attraction of the magnet. When rod actuation to open the exhaust air valve occurs, the lever moves with added impetus of the momentum gained by pulling the control rod from the magnet and having the top of the arcuate slot strike the lever on its way downward. As a result, operating pressure and pump volume is improved. Provision is made for release of the magnet to enable momentum of the fall rod to assist in valve opening.

8 Claims, 5 Drawing Sheets

ENHANCED LEVER MECHANISM FOR CONTROLLERLESS PNEUMATIC PUMP

This invention relates to lever actuated pump valves, such as those lever actuated valves disclosed in commonly U.S. Pat. No. 5,004,405. Specifically, improvement to the disclosed lever and float actuation of a pump is obtained by relieving enhancing forces on the actuating lever by substantially relieving all forces associated with the control rod during air valve opening and using momentum from control rod movement during the exhaust valve opening (air inlet valve closure) cycle.

BACKGROUND OF THE INVENTION

Lever actuated pumps such as that set forth in commonly U.S. Pat. No. 5,004,405 issued Apr. 2, 1991 entitled PNEUMATICALLY POWERED SUBMERSIBLE FLUIDS PUMP WITH INTEGRATED CONTROLS are known. FIGS. 1A and 1B from that patent are set forth in this specification so that the problem that this invention solves can be understood.

The reader should remember that understanding the problem to be solved constitutes invention. I therefore claim invention in understanding where and why the design of commonly Breslin '405 Patent can be improved.

U.S. Pat. Nos. 5,358,037 and 5,358,038 to Edwards et al. issued Oct. 25, 1994 also show a pump with a slack device and lever combination. These patents do not use a magnet to enhance control rod movement upwards, nor do they use a magnet to impart momentum to the lever mechanism on the downward cycle.

FIGS. 1A and 1B are taken from commonly Breslin '405 patent. Operation of both the embodiments of FIGS. 1A and 1B can be simply summarized for purposes of the present application; for a more detailed explanation the reader is referred to the original patent document. Accordingly, commonly U.S. Pat. No. 5,004,405 is hereby incorporated by reference as if fully set forth herein.

Referring to FIG. 1A, pump P includes casing C with inlet bottom check valve 10, outflow conduit O, with top check valve 12 for outflow. Stopping here, it should be apparent to the reader how pumping action of the pump can operate. Assuming that the pump is periodically flooded interior of casing C through bottom check valve 10, air pressure introduced periodically interior of casing C will cause pumping. Specifically, and when air pressure is introduced interiorly of casing C, bottom check valve 10 will close and top check valve 12 will open with liquid being expelled into opening 14 of outflow conduit O and out through top check valve 12.

Understanding this much, it is necessary to review how float F, lever L, and air inlet valve $V_1$ cause air pressure to be introduced interiorly of pump P as a function of the flooding of casing C.

Presuming flooding of casing C, float F moves upward contacting stop 16 on rod R. Rod R connects at joint J to pivoted lever L pivoted about pivot 18. Pivot 18 has air inlet valve actuator 20 open air inlet valve $V_1$ causing compressed air to enter casing C. Outflow of pumped fluid occurs.

When sufficient outflow of the pumped fluid occurs, it is required that the pumping air pressure be relieved. This much can be understood with respect to FIG. 1B.

Presuming that the liquid level within casing C drops because of the described pumping, float F will also drop. When float F drops, rod R will drop causing lever L at joint J to likewise drop. This will withdraw air discharge valve actuator 22 from air discharge valve $V_2$ and air discharge will occur. When the air discharge occurs, flooding of casing C can likewise occur. By allowing this cycle to endlessly repeat, useful pumping results.

Having summarized the operation of the prior art design, I will now designate some possible areas of improvement. As these possible areas of improvement are not set forth in the prior art, I claim invention is understanding and solving these problems.

Problems Observed

First, it will be observed that in opening air inlet valve $V_1$ and air discharge valve $V_2$, lever L must have rod R follow the lever through connection at joint J. Thus when lever L acts to open air inlet valve $V_1$ or to open air discharge valve $V_2$, both lever L and rod R—as well as anything attached to those members—must move together and act together to cause air inlet valve actuator 20 to open air inlet valve $V_1$ or cause air discharge valve actuator 22 to open air discharge valve $V_2$. It would be desirable if such movement could occur during the upward travel of the rod and yet employ the weight and momentum during the downward travel of the rod. This is especially true when it is remembered that the opening of the valves must occur against pressure acting on the valves.

Secondly, the design set forth has been adapted to relatively narrow diameter pump casings in the range of 2 inches diameter. Consequently, lever L is short. When lever L is short, the leverage produced is small.

Thirdly, it is necessary to observe the action of lever L at joint J on rod R. Specifically, rod R not only moves up and down, but additionally has side-to-side movement. As lever L pivots, joint J changes its distance from outflow conduit O. Rod R must likewise change its distance from outflow conduit O. Friction can result from such movement.

These outlined problems may seem trivial to the reader. The problems are not trivial. Specifically, and because of the following disclosed design, I have been able to increase the air operating pressure of air operating pressure capability of the prior art pump configuration shown in FIG. 1 by about 50% (from 230 psi to 330 psi). This enables the pump to be used in deeper wells. Further, pumping efficiency—the volume capacity pumped—has had a similar improvement.

SUMMARY OF THE INVENTION

In float actuated pump having a rod and lever actuation from the float, an improved connect between the rod and lever is disclosed enabling valve closure substantially free of constraint by the rod and attached fittings. Specifically, a valve actuating lever biased by a counter weight at one lever end, connects to the operating rod at the improved joint at the other lever end. The end of the rod is provided with an arcuate slot. The lever connects at a lever pin to the arcuate slot. The curvature of the slot prevents towards and away movement of the rod relative to outflow conduit "O"; the length of the slot gives free up and down rod movement at the lever pin within the elongate slot. The arcuate slot is fabricated into a slack device mounted on top of the control rod. The slack device is made of a material that is attracted to a magnet. A magnet is included in the pump head, above the slack device. This magnet has sufficient strength to support the rod and all attachments; the magnet has insufficient strength to support the float when added to the rod and all attachments.

When rod actuation to open the air inlet valve occurs, the lever moves free of rod constraint by movement with the elongate slot and the attraction of the magnet to the slack device. When rod actuation to open the exhaust valve (and close the air inlet valve) occurs, the lever moves with the aid of the control rod weight and the added momentum of the control rod after it is pulled down from the magnet by the weight of the float on the control rod. As a result, operating pressure and pump volume is improved.

DESCRIPTION OF THE PREFERRED EMBODIMENT

Figure 1A:
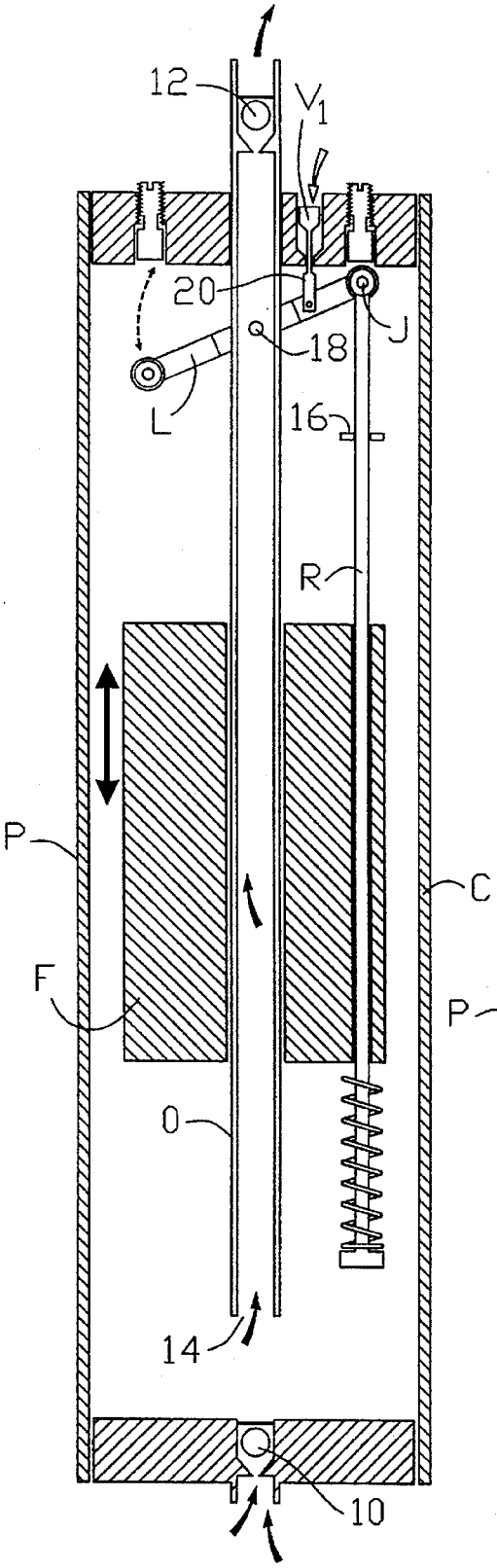
FIG. 1A PRIOR ART
FIGS. 1A and 1B are respective side elevation sections of the same pump taken from commonly owned prior art U.S. Pat. No. 5,004,405 with opposite sides of the pump being illustrated with FIG. 1A illustrating valving enabling the pumping admittance of compressed air to the pump casing and FIG. 1B enabling the discharge of the compressed air so that the pump casing can be flooded for the next operating cycle.
Figure 1B:
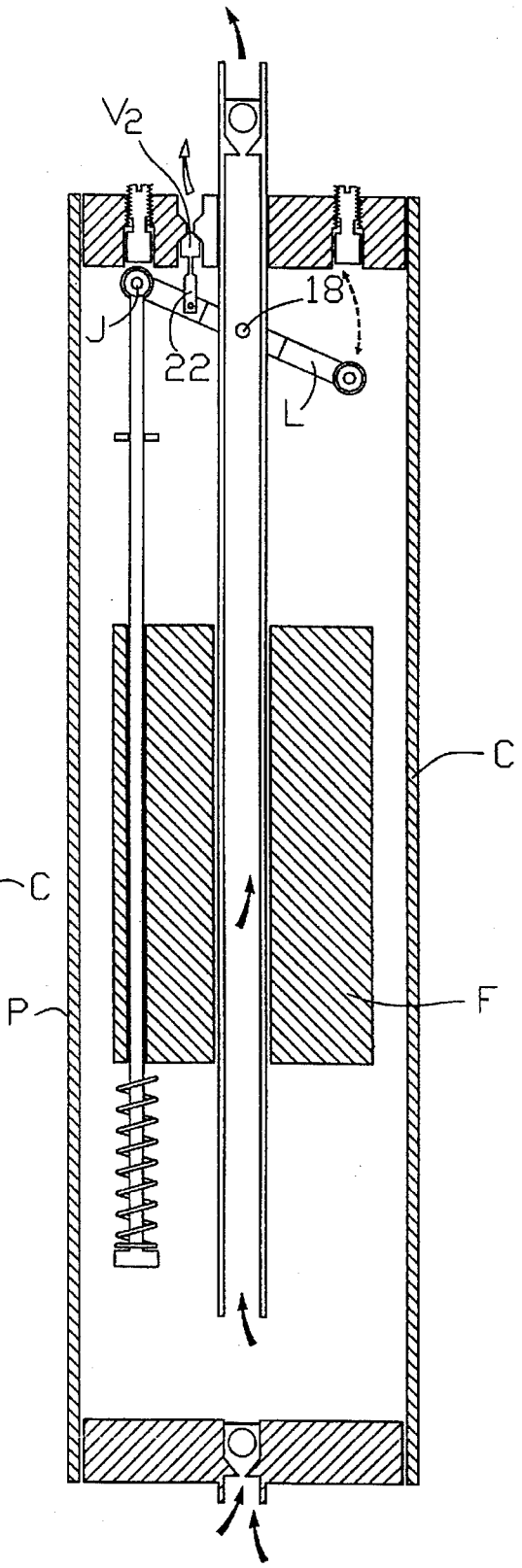
FIG. 1B PRIOR ART
Figure 2:
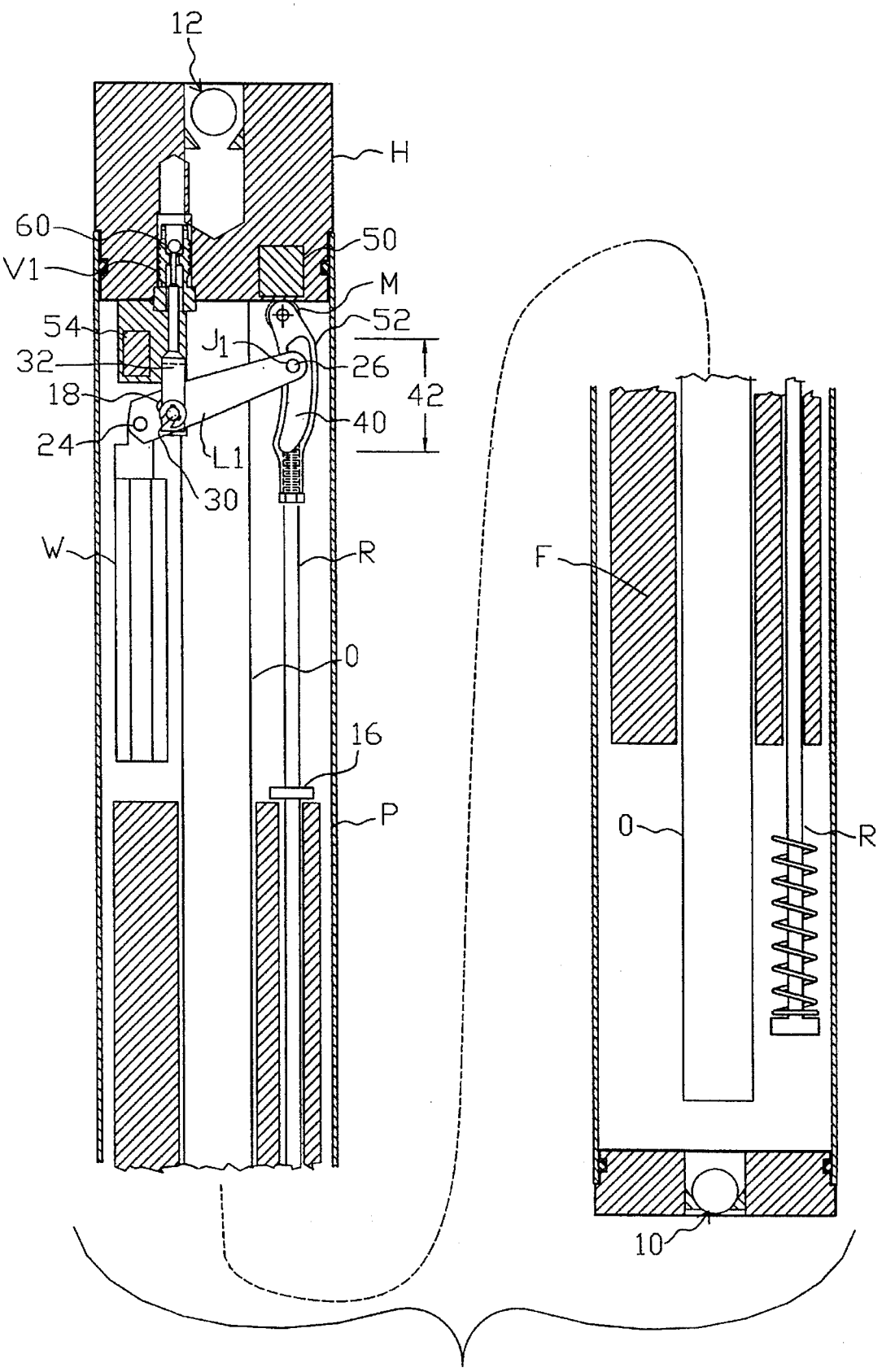
FIG. 2 illustrates the design of this invention in an embodiment analogous to FIG. 1A setting forth the improved joint connection utilized for the valving utilized to admit pumping compressed air within the pump casing.

Referring to FIG. 2, lever $L_1$ is connected at pivot 18 which in turn is mounted at outflow conduit O. Counter weight W is connected to lever $L_1$ at pin 24 and biases the lever arm downward at pin 24. Lever arm $L_1$ at the opposite end from pin 24 has follower pin 26. Medially of lever $L_1$ and slightly offset from pivot 18 there is provided air poppet actuator pivot 30 with connected air poppet actuator 32.

Figure 3:
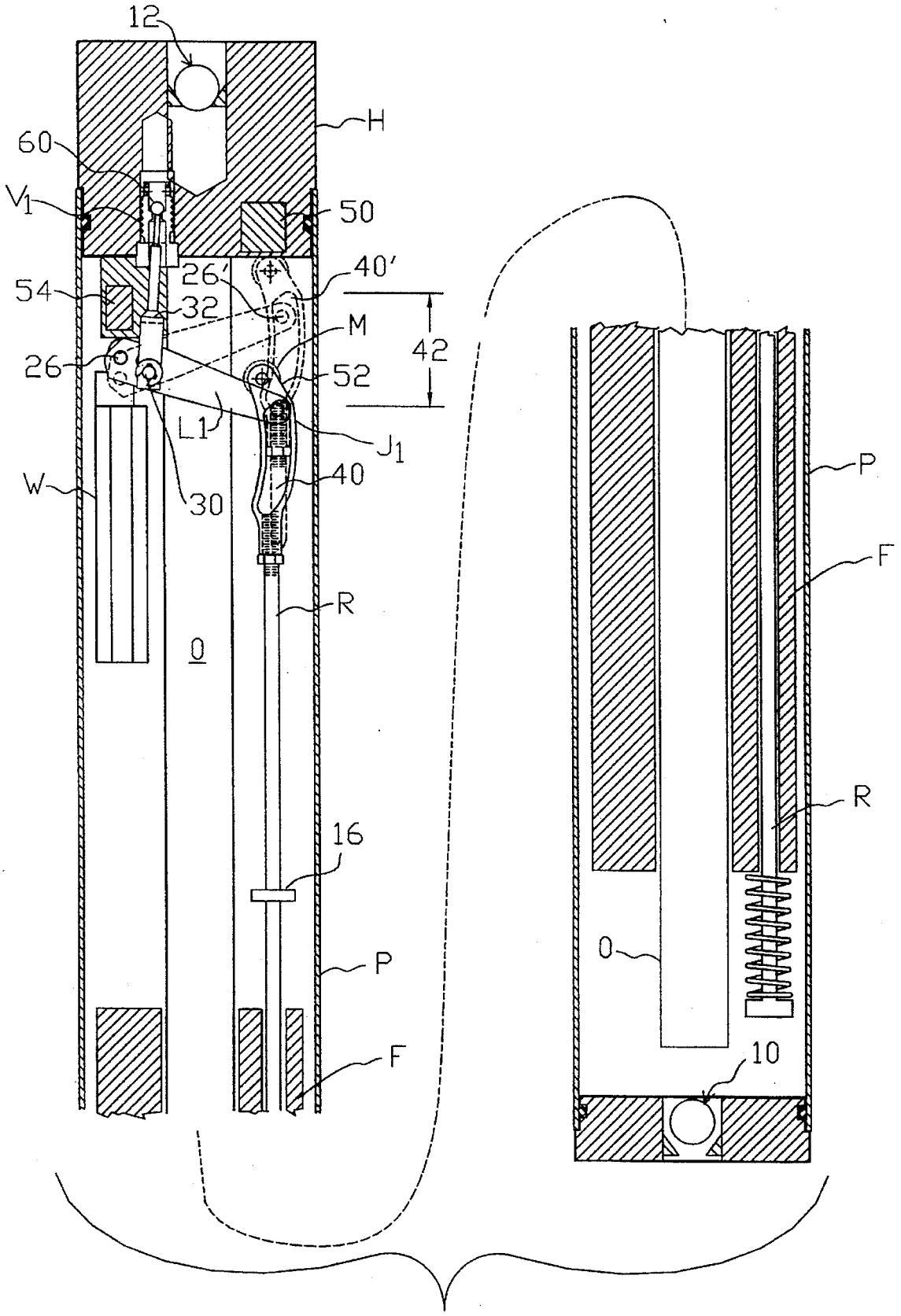
FIG. 3 illustrates the design of FIG. 2 immediately after downward movement of the float and attached rod.
Figure 4:
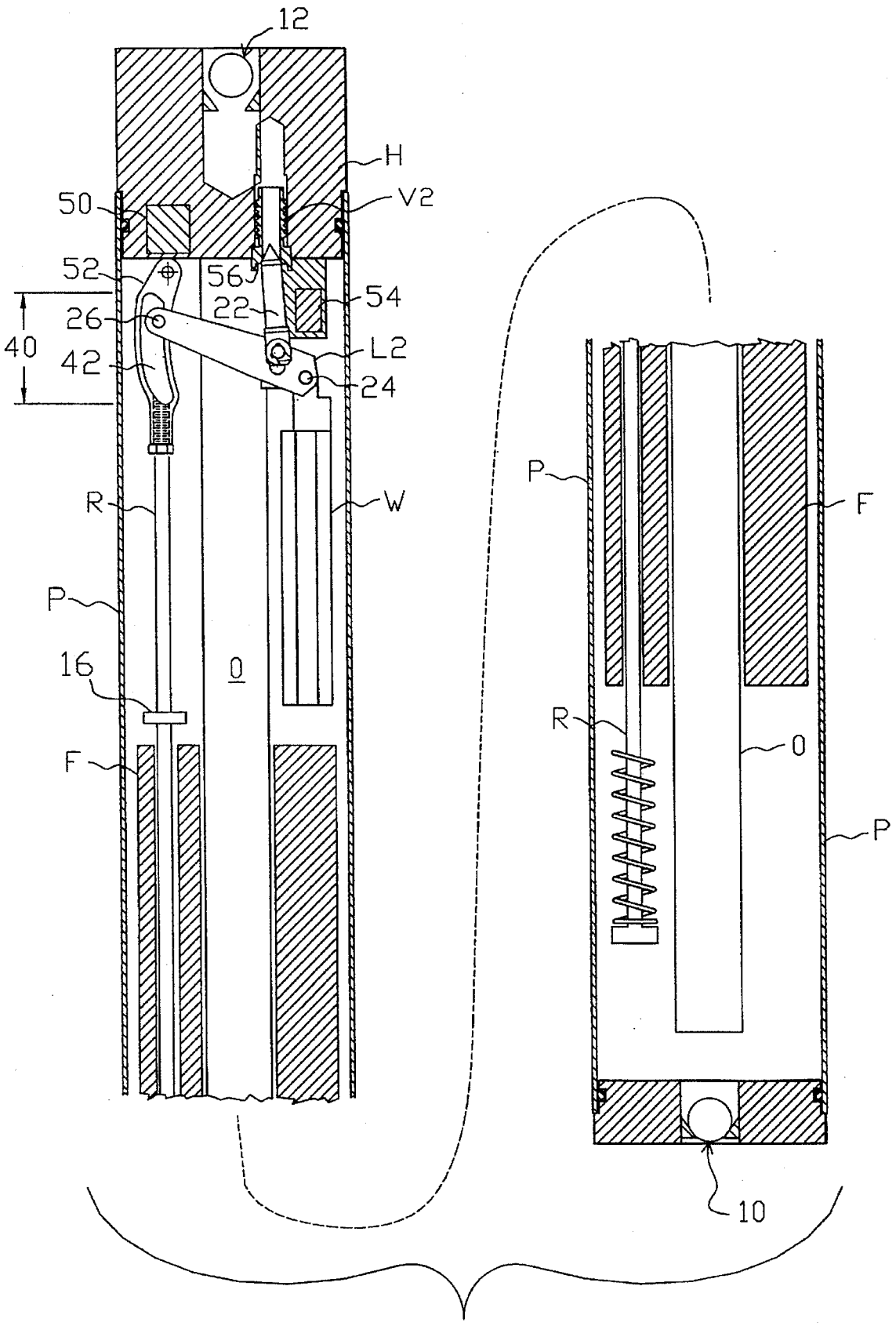
FIG. 4 is a view similar to FIG. 2 from the opposite side of the pump showing the rod in the elevated position.
Figure 5:
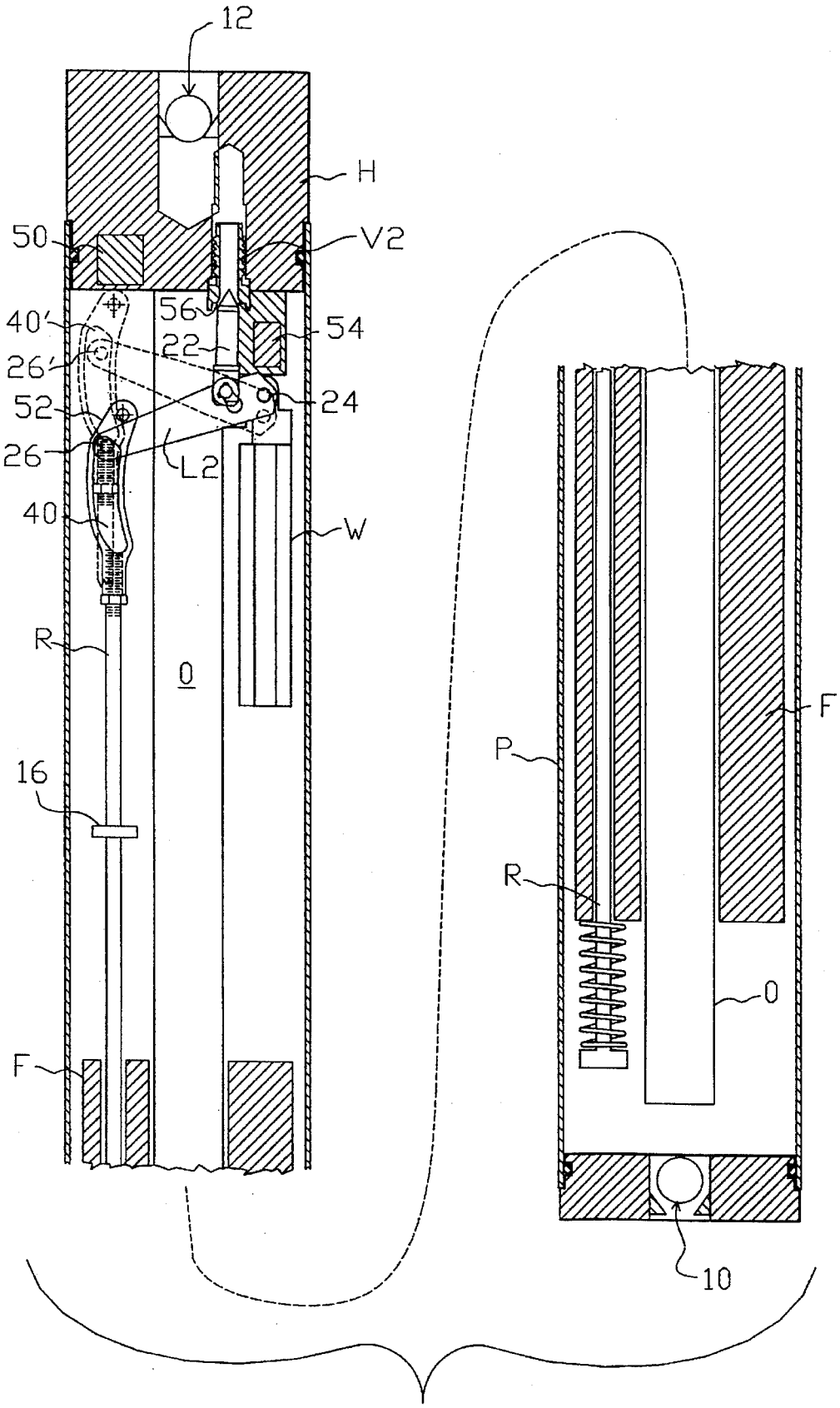
FIG. 5 illustrates the pump apparatus immediately after downward motion of the float and rod has occurred.

It will be understood that FIGS. 2 and 4 are views from opposite sides of the pump with rod R elevated and ready to fall against the bias provided by counter weight W. FIGS. 3 and 5 are views from the same respective opposite sides after rod R has fallen and overcome the bias of counter weight W. FIGS. 2 and 3 illustrate the closing air inlet valve $V_1$. FIGS. 4 and 5 illustrate the opening of air discharge valve $V_2$.

Referring to FIGS. 2–5 pump P includes casing C with inlet bottom check valve 10, outflow conduit O, with top check valve 12 for outflow. Stopping here, it should be apparent to the reader how pumping action of the pump can operate similar to the operation set forth in commonly owned U.S. Pat. No. 5,004,405. Assuming that the pump is periodically flooded interior of casing C through bottom check valve 10, air pressure introduced periodically interior of casing C will cause pumping. Specifically, and when air pressure is introduced interiorly of casing C, bottom check valve 10 will close and top check valve 12 will open with liquid being expelled into conduit O and out through top check valve 12.

Understanding this much, it is necessary to review how float F, lever L, and air inlet valve $V_1$ cause air pressure to be introduced interiorly of pump P as a function of the flooding of casing C.

Referring to FIGS. 2, and presuming flooding of casing C, float F moves upward contacting stop 16 on rod R. Rod R connects at improved joint $J_1$ to lever $L_1$ pivoted about air popper actuator pivot 30. Air poppet actuator pivot 30 has air popper actuator 32 open air inlet valve $V_1$ causing compressed air to enter casing C. Outflow of pumped fluid occurs.

When sufficient outflow of the pumped fluid occurs, it is required that the pumping air pressure be relieved. This much can be understood with respect to FIG. 5.

Presuming that the liquid level within casing C drops because of the described pumping, float F will also drop. When float F drops, rod R will drop causing lever $L_2$ to likewise drop. This will withdraw air discharge valve actuator 22 from air discharge valve $V_2$ and air discharge will occur. When the air discharge occurs, flooding of casing C can likewise occur. By allowing this cycle to endlessly repeat, useful pumping results.

It can be instructive to stop the description at this juncture, and consider the action of air poppet actuator 32 under the bias provided by counter weight W. Presuming that rod R is fully upwardly biased by float F (See FIG. 3), air poppet actuator 32 will open air inlet valve $V_1$. It is the purpose of this invention to allow lever $L_1$ to effect such opening movement without constraint in any way by rod R.

Improved joint $J_1$ can now be described. First, it will be observed that improved joint $J_1$ includes a slack device 52 with an arcuate slot 40 at the top of the control rod R. Arcuate slot 40 is given a curvature so that interference with lever $L_1$ at follower pin 26 does not occur at any elevation of rod R responsive to the movement of the float. Thus, there is no friction generating side-to-side movement of rod R relative to outflow conduit O during rod movement.

Second, arcuate slot 40 is given elongate dimension 42 in the direction of movement of rod R. Presuming that rod R is in the illustrated, fully upward, position of FIG. 2, arcuate slot 40 permits follower pin 26 of lever $L_1$ to move upward in an unconstrained disposition without interference from rod R or any appliance attached to rod R.

At the upper limit of travel of rod R, within the pump head H, there is mounted a magnet 50. Slack device 52 with arcuate slot 40 is made of a material that is attracted to the magnet 50. Magnet 50 in attraction to slack device 52 has sufficient attraction to support rod R and attached appliances. Magnet 50 in attraction to slack device 52 has insufficient attraction to support rod R and attached appliances with significant added weight from float F (See FIG. 5).

Lever $L_1$ is prevented from traveling further by the exhaust valve poppet 22 contacting its seat 56. It could also be held from further travel by other methods.

Arcuate slot 40 in slack device 52 has an elongate dimension 42 which extends beyond and above the distal end of lever $L_2$ at follower pin 26. That is to say, when follower pin 26 is in the full upward position on lever $L_2$, follower pin 26 still does not reach the upward limit of elongate slot 40. Magnet 50 has sufficient attraction to slack device 52 to support rod R and all attached appliances. Magnet 50 has insufficient attraction to slack device 52 to support rod R and all attached appliances, with significant addition of weight from float F. A magnet M can be placed at the end of rod R to provide magnetic attraction.

Once the combination is stated, operation can be understood. Rod R will remain held in the upward position until the draining of liquid from casing C of pump P causes the float F to bias rod R. When this bias reaches the point where significant float weight is on control rod R, magnet 50 releases rod R. Rod R falls and the upper end of arcuate slot 40 in slack device 52 contacts pin 26 on lever $L_1$ and this momentum along with the weight of the control rod R and the float F, through lever $L_1$ overcomes the bias supplied by counter weight W. Air poppet actuator 32 moves out of opening engagement with air inlet valve $V_1$. Flooding of the casing with pumping compressed air ceases. Pump outflow stops. Of course this lever movement also serves to pull exhaust valve poppet 22 away from its seat 56 and allow the compressed air to exhaust and the pump to fill with fluid.

It is interesting to consider the situation when float F puts significant weight on rod R and the attached appliances. A two part operation follows.

First, magnet 50 releases rod R. Rod R with slack device 52 and arcuate slot 40 begins to fall. Falling continues until the top of elongate slot 40' comes into contact with follower pin 26'. Stated in other terms, rod R transfers momentum to lever $L_1$ as follower pin 26' moves into contact with the top of elongate slot 40'. (See FIG 3)

Second, arcuate slot 40' contacts follower pin 26' with the momentum of falling rod R. Here, the weight of rod R, the bias of float F, and the accumulated momentum of rod R all serve to open air discharge valve $V_2$. A positive opening motion of air discharge valve $V_2$ results.

It is interesting to consider the situation when float F lifts rod R and the attached appliances during the "fill" cycle of the pump. A two part operation follows.

The bottom of arcuate slot 40 contacts pin 26. Since lever $L_1$ is held in position by counterweight magnet 54, the float F will submerge slightly as fluid continues to fill the pump. When sufficient float F is submerged, magnet 54 will release the counterweight W and lever $L_1$ will begin to pivot. Rod R and pin 26 travel upwards together, Rod R being carried by float F and pin 26 being pushed by float F and pivoted by counterweight W.

Second, as lever $L_1$ pivots so that air inlet poppet 32 approaches air inlet ball 60, magnet 50 attracts slack device 52, thus taking some of the weight of rod R from float F. When air inlet valve V1 opens, rod R is sufficiently attracted to magnet 50 so that the weight of rod R does not interfere with the travel of lever $L_1$ or the opening of valve $V_1$. In this way the invention aids in the upwards travel of pin 26 and the pivoting of lever $L_1$.

It will be understood that this invention will admit of modification. For example, the illustrated levers can be pivoted and any various location. This location can range from any end to the middle of the lever. Further, bias of the lever can occur by any manner. I happen to illustrate counter weight bias. Spring bias will work as well. Further, it will be understood that magnet is a preferred detent. Other detents will work as well for the release of rod R. Likewise, I have illustrated a detent mechanism in the form of a magnet. Other detent mechanisms will work as well.

What is claimed is:

1. In an actuator for a pump, the pump having a hollow casing for flooding of liquid to a level within the hollow casing to enable the liquid to be pumped, the actuator having in combination, a lever arm member;

a pivot for the lever arm member;

first means for biasing the lever arm member in a first direction;

a float for following the level of liquid within the pump;

second means for biasing the lever arm member in a second direction opposite to the first direction from the float responsive to the level of liquid within the pump, and a valve for permitting fluid flow;

a valve actuator from the lever arm member to a valve for actuating the valve for permitting fluid flow, the second means including, a rod member connected to the float at one portion and moveable between a fully upward position and a downward position;

the rod member connected to the lever arm member at another portion; and, a joint between the lever arm member and the rod member;

the improvement to the combination at the joint between the lever arm member and the rod member comprising in combination:

a detent mechanism for releaseably engaging the rod member when the rod member is in the fully upward position;

an elongate slot configured within the rod member;

a slot following pin in the lever arm member; and, the elongate slot being dimensioned to have a spatial interval above the slot following pin whereby when the detent mechanism releases the rod member, the rod member falls with accumulated momentum on the slot following pin.

2. In an actuator for a pump according to claim 1; and wherein the detent mechanism to the rod member has a release force sufficient to support at least a partial weight of the rod.

3. In an actuator for a pump according to claim 2 and including:

the detent mechanism includes a magnet.

4. In an actuator for a pump, the pump having a hollow casing for flooding of liquid to a level within the hollow casing to enable the liquid to be pumped, the actuator having in combination, a lever arm member;

a pivot for the lever arm member;

first means for biasing the lever arm member in a first direction;

a float for following the level of liquid within the pump;

second means for biasing the lever arm member in a second direction opposite to the first direction from the float responsive to the level of liquid within the pump, and a valve for permitting fluid flow;

a valve actuator from the lever arm member to the valve for actuating the valve for permitting fluid flow, the second means including, a rod member having weight connected to the float at one portion;

the rod member connected to the lever arm member at another portion; and, a joint between the lever arm member and the rod member, the improvement to the combination at the joint between the lever arm member and the rod member comprising in combination:

a detent mechanism attached to the rod member at a first portion and attached to the casing at a second portion;

the detent mechanism having sufficient attraction to support at least a portion of the weight of the rod member whereby when the float biases the rod member with a force exceeding the weight of the rod member supported by the detent mechanism, the detent mechanism releases.

5. In an actuator for a pump according to claim 4 and wherein the detent mechanism includes:

a magnet adjacent the rod member;

a ferro-magnetic material placed on the rod member for attraction to the magnet during travel of the rod member;

the magnet and the ferro-magnetic material having sufficient attraction to support at least a portion of the weight of the rod member whereby when the force on the rod member exceeds at least a portion of the weight of the rod, the magnet releases from the ferro-magnetic material.

6. In an actuator for a pump according to claim 4 and wherein the joint further includes:

an elongate slot attached to the rod member;

a slot following pin attached to the lever arm member; and, the elongate slot dimensioned to permit unrestricted movement of the slot following pin during lever arm member movement to actuate the valve.

7. In an actuator for a pump according to claim 6 and wherein:

the elongate dimension of the slot extends above the following pin when the detent is engaged whereby the rod gains momentum when released by the detent.

8. In an actuator for a pump according to claim 6 and wherein:

the elongate slot extends above the slot following pin when the detent mechanism is engaged whereby the rod member gains momentum when released by the detent mechanism.

* * * * *